United States Patent [19]

Peterle

[11] Patent Number: 4,744,405

[45] Date of Patent: May 17, 1988

[54] DEVICE FOR LOCKING CORE BOXES ON SUPPORTING PLATES OF MOLDING SAND CORE-FORMING MACHINES

[76] Inventor: Guido Peterle, Via Novara 37, 28021 Borgomanero (Province of Novara), Italy

[21] Appl. No.: 68,489

[22] Filed: Jun. 29, 1987

[30] Foreign Application Priority Data

Jul. 9, 1986 [IT] Italy ..... 21080 A/86

[51] Int. Cl.[4] ..... B22C 7/06; B22C 13/12

[52] U.S. Cl. ..... 164/228

[58] Field of Search ..... 164/228, 229, 230, 231, 164/232, 233, 234, 374

[56] References Cited

U.S. PATENT DOCUMENTS 2,901,792 9/1959 Covitt ..... 164/233 X
4,674,552 6/1987 Howe ..... 164/231 X

FOREIGN PATENT DOCUMENTS 547748 4/1932 Fed. Rep. of Germany ..... 164/228
54-40368 12/1979 Japan ..... 164/228
588315 5/1977 Switzerland ..... 164/228
508522 7/1939 United Kingdom ..... 164/228

*Primary Examiner*—Nicholas P. Godici
*Assistant Examiner*—J. Reed Batten, Jr.
*Attorney, Agent, or Firm*—Guido Modiano; Albert Josif

[57] ABSTRACT

Device for rapidly locking core boxes on respective supporting plates, comprising a pin vertically rigidly attached to the base of a core box and freely insertable in a corresponding first hole extending in the supporting plate, at least one recess in the pin, defining an engagement portion for a cam element mounted rotatably, without axial translatory motion, within the supporting plate in such a position as to interfere, only with a protruding part thereof, with the recess so as to lock the pin to the supporting plate and to disengage the pin after the partial rotation of the cam element, retention members being furthermore provided for the cam element, preventing axial translatory motion thereof. The cam element furthermore comprises an end tang protruding from the supporting plate, for rotating the cam element by a key and the like.

6 Claims, 1 Drawing Sheet

DEVICE FOR LOCKING CORE BOXES ON SUPPORTING PLATES OF MOLDING SAND CORE-FORMING MACHINES

BACKGROUND OF THE INVENTION

The present invention relates to a device for rapidly locking and centering core boxes on respective supporting plates, particularly indicated for use in automatic molding sand core-forming machines.

As is known, machines for forming cores in molding sand use openable dies, that is, dies composed of two half-dies mounted on adapted supports so as to allow the mating closing approach thereof, thus allowing their filling with sand which is thrown or shot under pressure through a launch head, and subsequently opened by moving apart both the half-dies or one thereof with respect to the other, so as to allow extraction of the formed core.

Generally, these half-dies are supported by box-like containment body, commonly known as "core box", which is supported by, and removably rigidly connected to, a quadrangular plate peripherally provided with a raised border with quadrangular cross section so as to define a planar resting and fixing frame for the core box, said frame being substantially formed by supporting plates with a limited extension.

Correct positioning and stable locking of core boxes on respective supporting plates in currently achieved by means of locating pegs facilitating their positioning and of a plurality of locking screws, arranged in various manners and in various accessible positions.

Since change and replacement of core boxes is, at least in some kind of processes, rather frequent, the presence of a plurality of screws to be operated entails considerable work times which are to be considered as substantially idle times, that is, unproductive.

Moreover, the provision of a plurality of threaded holes with related screws in practice entails difficulties in design and manufacture which also influence the overall cost of the core boxes and of the supporting plates, besides requiring regular maintenance and availability of screws and tools for their application.

Thus, the complexity due to the plurality of locking screws and the economic burdens which in practice derive therefrom substantially affect negatively the productivity of the forming machine and its practicality in use.

SUMMARY OF THE INVENTION

Therefore, the aim of the present invention is to provide a simple and practical device, capable of eliminating the disadvantages and limitations of known systems for locking core boxes, and, most of all, such as to perform the double centering and locking function in a rapid, safe manner without the intervention of skilled personnel.

Another object of the invention is to provide a rapid locking device which is safely reliable, has a small cost and, most of all, can be used on core forming machines of any type, automatic or semiautomatic.

Still another object is to provide a rapid locking device designed so as to be operable both manually and mechanically, by means of kinematisms which are easily applicable to the control dowel of the device and controlled by a suitable programmed-operable motor.

These and other objects, which will become apparent from the following detailed description, are achieved by a rapid and removable device for locking core boxes on respective supporting plates used in molding sand core-forming machines, said device consisting, according to the present invention, of a pin or dowel, vertically rigidly attached to the base of a core box and freely insertable in a corresponding hole provided in the supporting plate, transversely to said pin or dowel there being provided at least one recess or cavity adapted to act as an engagement means for an eccentric or cam element rotatably mounted, without axial translatory motion, within the supporting plate in such a position as to interfere, only with its eccentric part, with said recess so as to lock said pin to the supporting plate and to uncouple said pin after the partial rotation of the cam element, retention means being furthermore provided for said cam element for preventing axial translatory motion thereof, as well as means, external to the supporting plate, for operating said cam element by means of a key or the like or by means of a kinematism with a programmed-operable motor.

More in particular, said cam element preferably consists of a cylindrical dowel freely rotatable mounted on the supporting plate in a position transverse to the pin rigidly associated with the core box and longitudinally provided with a flattened portion such as to allow, when moved in a position parallel to the cylindrical surface of the pin rigidly associated with the core box, extraction of said pin from its retention hole, and, when the dowel is rotated through approximately 180°, insertion of the cylindrical portion of the dowel in the transverse recess of the pin, so as to lock said pin and the related core box to the supporting plate.

BRIEF DESCRIPTION OF THE DRAWINGS

The invention is described in greater detail hereinafter in a preferred and non-limitative embodiment, with reference to the accompanying drawing, given only by way of non-limitative example, where.

DESCRIPTION OF THE PREFERRED EMBODIMENTS

Figure 1:
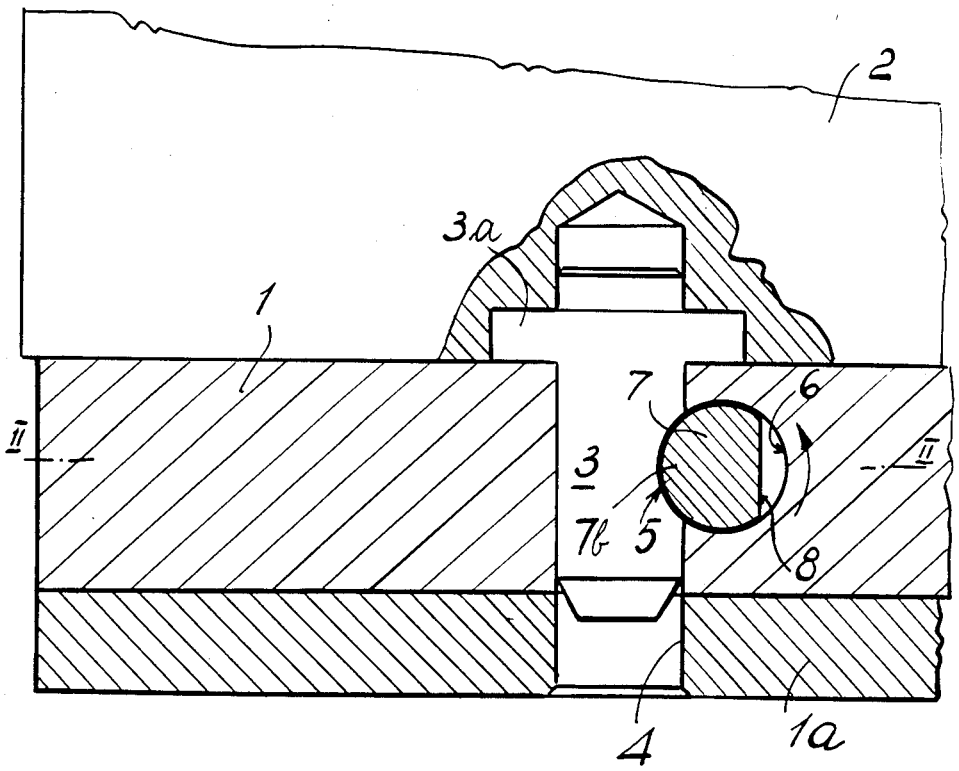
FIG. 1 is a vertical cross section view of a locking device, according to the invention, applied to a core box supporting plate and illustrated in locking position.

With reference to the above mentioned figures, the rapid locking device object of the present invention is usable, as mentioned, to stably rigidly connect an ordinary core box, generally quadrangular, to the related supporting plate. Generally, the supporting plate consists of a quadrangular frame 1 projecting from a base plate 1*a* (FIG. 1); the frame is composed of quadrangular cross section plates, upwardly planar, so as to constitute a continuous resting plane for a core box 2.

The locking device comprises a cylindrical pin or peg 3, stably and vertically rigidly connected to the base of the core box 2 and having an annular abutment 3*a*, flush with the lower plane of the core box 2. Said pin 3 is intended to be freely inserted, with a slight play, within a first hole 4, provided vertically within the supporting plate 1 and extended also through the base plate 1*a*; said first hole 4 is a through hole to allow the discharge of any foreign matter from the hole during the insertion of the pin 3.

The pin 3 has, at a level corresponding to approximately half the thickness of the plate 1, a transverse recess 5, substantially shaped as a cylinder sector having its longitudinal axis perpendicular to the longitudinal axis of the pin 3, this recess 5, as will be described hereinafter, defining means for locking the pin 3 within the supporting plate 1.

The supporting plate 1 further comprises a second cylindrical hole 6 communicating with the first hole 4 so as to face the pin 3 and having a longitudinal axis extending perpendicular to the axis of the pin 3. The second hole 6 rotatably accommodates a substantially cylindrical dowel 7 countershaped thereto and having, outside the plate 1, an extension *7a* (FIG. 2) with flattened lateral surfaces to facilitate gripping through an operating key; the dowel 7 furthermore has a longitudinal flattened portion 8, obtained from a starting cylindrical member by removing a cap substantially equal in shape and dimensions to the cylindrical sector-shaped recess 5 of the removable pin 3. Thus, as visible, when the dowel 7 is in its locking position, shown in FIG. 1, with its engagement portion *7b*, it protrudes from the second hole 6, engaging the recess 5, while when the dowel 7 is rotated so as to face the pin 3 with its flattened portion 8 (FIG. 2), the dowel is completely accommodated in the second hole 6 and does not protrude therefrom so as to free the pin 3. In order to prevent the axial movements of the dowel 7, two common retention rings (Seeger rings or the like) *8a* (FIG. 2) are provided at the two ends of said dowel.

Figure 2:
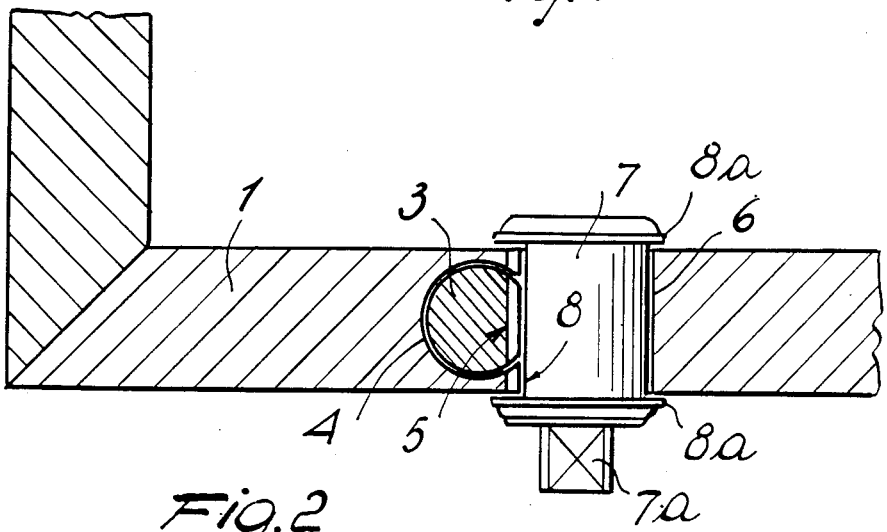
FIG. 2 is a transverse cross section view taken along line II—II of FIG. 1, with the core box released from the supporting plate.

It is therefore apparent that for locking the core box on the supporting plate 1 it is sufficient to insert the pin 3 in the hole 4 of the plate, keeping the flattened portion 8 of the dowel 7 facing the pin 3 as illustrated in FIG. 2, then to rotate through approximately 180° the dowel 7, by means of a key or the like element gripping the extension or tang *7a*, until the engagement portion of the dowel 7 (opposite to the flattened portion 8) engages with the recess 5 of the pin 3. Locking is thus ensured by means of a single rotary motion of the dowel 7 (FIG. 1).

In order to perform uncoupling, it is sufficient to rotate the pin 7 through approximately 180° until the flattened portion 8 returns to a position parallel to the generatrix of the pin 3, thus allowing extraction of the pin 3 from the supporting plate.

The device according to the invention thus allows a core box to be rapidly and easily locked on the related supporting plate; in fact, if a plurality of such devices is arranged (for example, four devices at the corners of the frame constituting the supporting plate), it is possible, with a single partial rotation of the four dowels 7, to achieve locking and, when required, to achieve uncoupling of the core box. The locking device described above also allows to eliminate the common locating pegs upon positioning of the core box on the plate; in fact the pins 3, rigidly connected to the core box, also automatically operate as locating pegs, as well as locking pegs.

Again according to the invention, the tang or extension *7a* of the dowel 7 may be coaxially rigidly connected to a gearwheel orhed pinion, which can be kept in meshing coupling to a rectilinear rack, and the latter can be made to move in both directions with a preset stroke and by means of a motor and a related control apparatus. In this manner it is possible to automatically perform locking and unlocking, thus eliminating efforts and manual intervention.

Naturally, in practice, the invention described above, according to a preferred embodiment, is susceptible to further modifications and variations, without thereby abandoning the protection scope of the invention.

I claim:

1. In a molding sand core-forming machine, a device for locking core boxes on respective supporting plates comprising a pin rigidly connected to a base portion of the core box and freely insertable in a corresponding first hole extending in the supporting plate, said pin having longitudinal axis and at least one recess extending transversely to said longitudinal axis, said device further comprising a cam element rotatably mounted in a second hole formed in the supporting plate, said cam element having an engagement portion which, in a first angular portion of said cam element, engages with said recess so as to lock said pin to the supporting plate and, in a second angular portion of said cam element, accommodated in said second hole, to disengage said pin, said device further comprising cam operating means, external to the supporting plate.

2. Device according to claim 1, wherein said cam element comprises a cylindrical dowel mounted freely rotatable in the supporting plate in a transverse position with respect to said pin and having a longitudinal flattened portion movable from a disengagement position, parallel to a generatrix of said pin, allowing extraction of said pin from said first hole, to a second engagement position, rotated through approximately 180°, wherein said engagement portion of said dowel engages said recess of said pin, so as to lock said pin and related core box to the supporting plate.

3. Device according to claim 2, wherein said cylindrical dowel comprises an end tang protruding from the supporting plate and defining flattened lateral surfaces engageable for rotating, in both directions, said cylindrical dowel.

4. Device according to claim 3, wherein said end tang is rigidly connected to a gear member, mounted, in meshing coupling, on a rack which is movable in both directions with a preset stroke by means of a motor and a related control apparatus to allow automatic rotation of said cylindrical dowel in locking direction and in unlocking direction.

5. Device according to claim 1, wherein said first hole is a through hole, so as to allow discharge of any foreign matter during insertion of said pin.

6. Device, according to claim 1, further comprising retention means cooperating with said cam element for preventing axial translation thereof.

* * * * *